United States Patent [19]

Perucchi

[11] Patent Number: 4,932,010

[45] Date of Patent: Jun. 5, 1990

[54] TIMEPIECE WITH AN ECCENTRIC DISPLAY MODULE

[75] Inventor: Norberto Perucchi, Ntel, Switzerland

[73] Assignee: Gianni Bulgari S.p.A., Rome, Italy

[21] Appl. No.: 387,042

[22] Filed: Jul. 31, 1989

[30] Foreign Application Priority Data

Aug. 4, 1988 [IT] Italy ..... 67739 A/88

[51] Int. Cl.[5] ..... G04B 19/04; G04B 37/00

[52] U.S. Cl. ..... 368/80; 368/88; 368/223; 368/300

[58] Field of Search ..... 368/76, 80, 88, 220, 368/223, 228, 297–300

[56] References Cited

U.S. PATENT DOCUMENTS 4,250,572 2/1981 Yoshida ..... 368/71

4,436,435 3/1984 Ushikoshi ..... 368/71

4,796,240 1/1989 Stevens ..... 368/300

*Primary Examiner*—Vit W. Miska

*Attorney, Agent, or Firm*—Sughrue, Mion, Zinn, Macpeak & Seas

[57] ABSTRACT

A timepiece includes a clock movement whose axis coincides with the central axis of the case, and a module for displaying the time which is constituted by a unit which is independent of the movement and of the case and whose axis is spaced from the central axis of the case. The elements for coupling the display module to the case are arranged symmetrically about the central axis of the case so as to enable the display module to be arranged in various possible eccentric positions around the central axis of the case.

1 Claim, 3 Drawing Sheets

TIMEPIECE WITH AN ECCENTRIC DISPLAY MODULE

DESCRIPTION

The present invention relates to a timepiece of the type comprising a case, a clock movement mounted in the case and having an output shaft defining the axis of the clock movement, and a module for displaying the time which is constituted by a unit independent of the case and of the movement and which includes at least one rotary member rotatable by the output shaft of the movement about an axis which constitutes the axis of the display module.

A timepiece of the type indicated above is illustrated in FIG. 1 of the appended drawings. With reference to this drawing, the timepiece comprises a case 1 in which there is mounted a clock movement 2 occupying the space shown in broken outline in the figure and having an output shaft, with an axis 3, which drives two hands 4, 5 for indicating the hour and the minute at any time. The case is provided with a device 6 for adjusting the time. A window 7 may also be provided on the face for displaying the date. In conventional timepieces of the type shown in FIG. 1, the axis 3 of the clock movement 2 coincides with the central axis of the case 1. At the same time, the display module carrying the hands 4, 5 has an axis about which the hands 4, 5 rotate and which also coincides with the axis of the case 1.

FIG. 2 of the appended drawings shows a timepiece in which the axis 3 of the movement 2 still coincides with the axis of the display module 10. In this case, however, the axes are spaced by a distance e from the central axis of the case 1, indicated 11. In the past, when it has been wished to locate the display eccentrically relative to the case, for aesthetic reasons, a solution of the type shown in FIG. 2 has always been used. This solution has two main disadvantages. On the one hand, the member 6 for adjusting the hands is always offset from one of the main diameters of the case, which can prevent certain shapes of case from being made; on the other hand, if such a solution is to be produced in a timepiece structure which was originally intended for a solution of the type shown in FIG. 1, the desired eccentricity can be achieved only in a certain position, which greatly limits the number of different models which can be produced with the same movement.

In order to avoid the aforesaid problem, the present invention provides a timepiece of the type indicated at the beginning of the present description, characterised by the combination of the following characteristics:

the axis of the clock movement coincides with the central axis of the case (1), the axis of the display module is spaced from the central axis of the case, the display module is connected to the timepiece case by means of coupling elements which are arranged symmetrically about the central axis of the case so as to enable the axis of the display module to be arranged in various possible eccentric positions around the central axis of the case.

Further characteristics and advantages of the present invention will become clear from the description which follows with reference to the appended drawings, provided purely by way of non-limiting example, in which.

Figure 1:
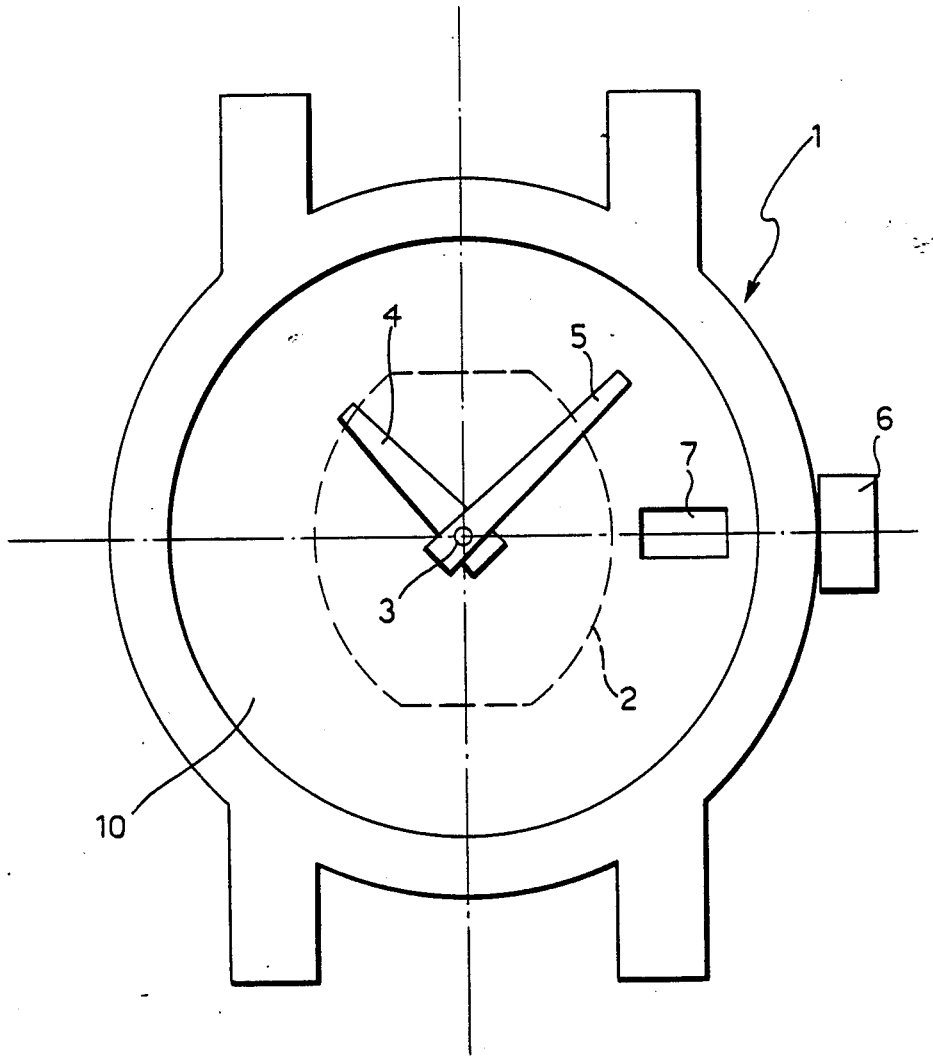
FIG. 1 PRIOR ART
FIGS. 1, 2 show two prior-art timepieces.
Figure 2:
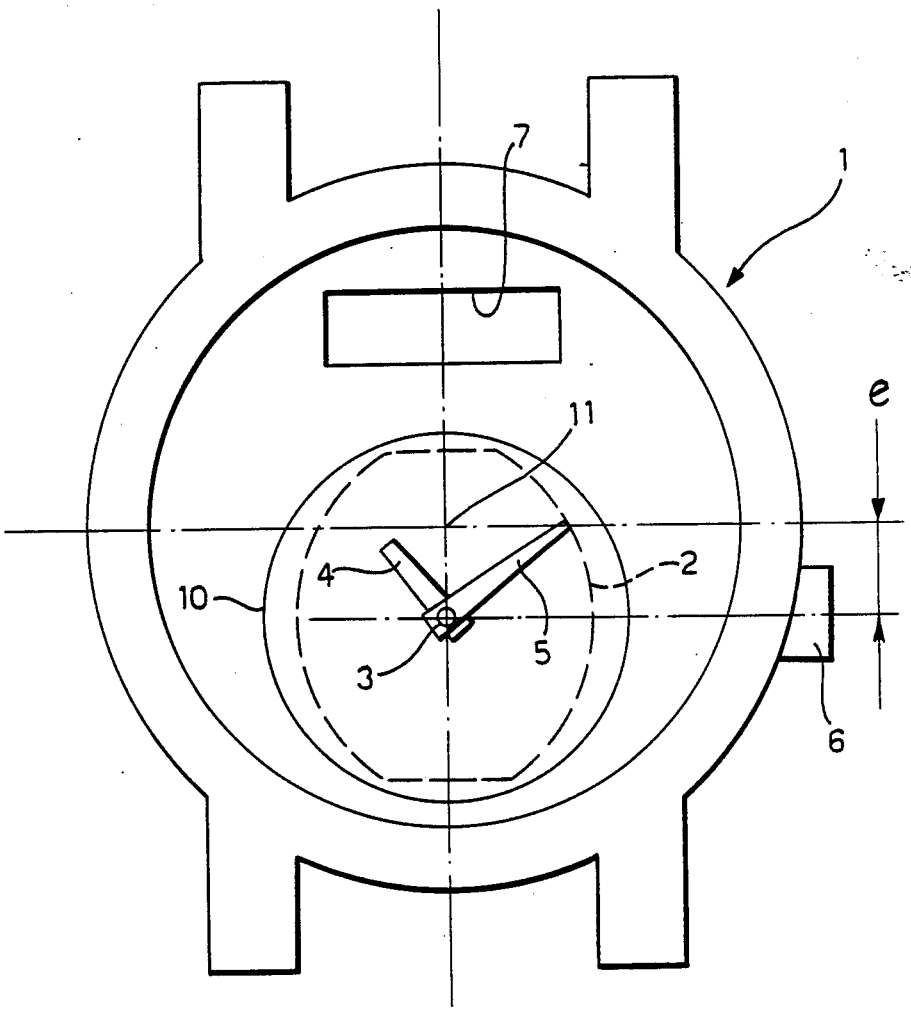
FIG. 2 PRIOR ART

The timepieces shown in FIGS. 1, 2 have already been described.

Figure 3:
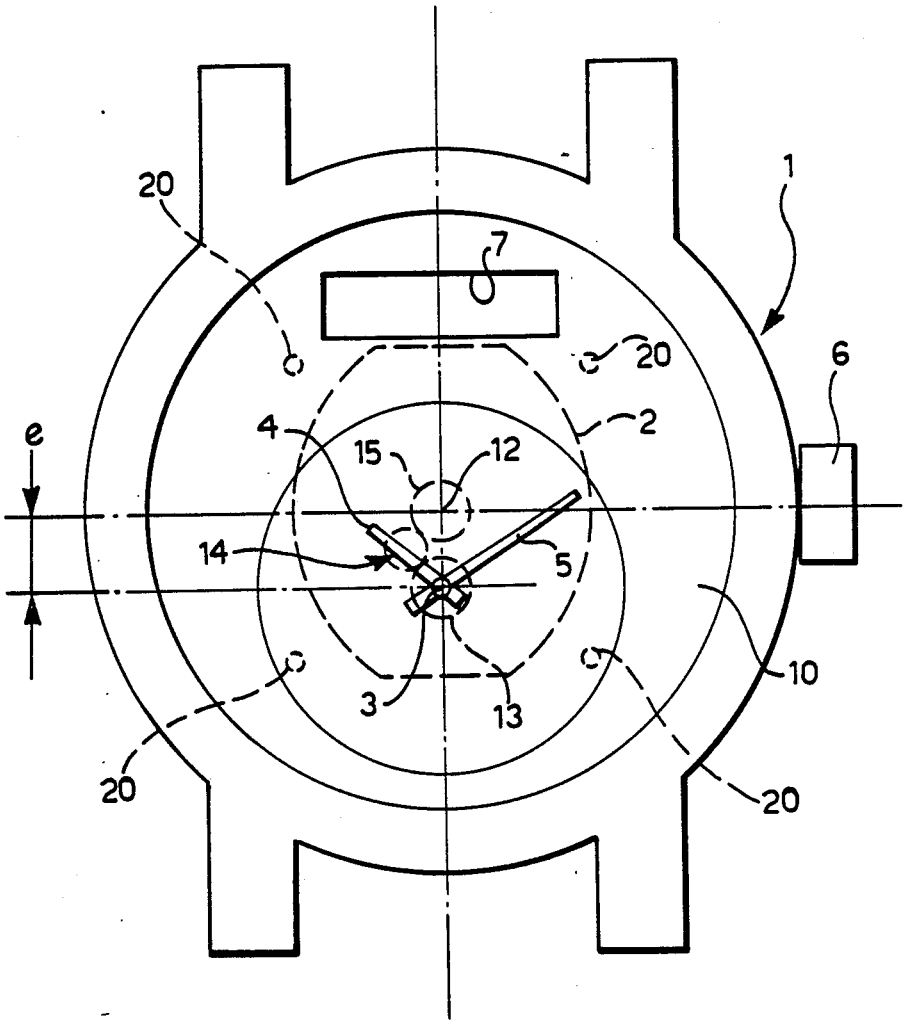
FIG. 3 is a schematic view of a timepiece according to the invention.

FIG. 3 shows a timepiece according to the invention, which has a case 1 with a central axis 12 and a clock movement 2 whose axis coincides with the central axis 12. A display module 10 is connected to the case and to the movement 2 and constitutes a unit independent of the case and of the movement. This display module supports two hands 4, 5 for rotation about an axis 3. The axis 3 of the display module is spaced from the central axis 12 of the case by a distance e. In the embodiment illustrated, the minute hand 5 is driven by a gear 13 which is in turn driven, through a transmission gear 14, by a gear 15 situated on the axis 12. The hour hand 4 is in turn driven by the hand 5 through a conventional transmission (not shown).

In the present description and in the appended drawings, the structural details of the clock movement and of the mechanical transmission between the clock movement and the display module are not illustrated since they may be of any known type and do not fall within the scope of the present invention. At the same time, the elimination of these details from the drawings makes the latter more readily and easily understood.

The display module 10 is mounted in the case 1 and connected to the movement 2 by means of four pins 20 which constitute the elements for coupling the module 10 to the case. The coupling elements are arranged symmetrically about the central axis 12 of the case so that the display module 10 can be mounted either in the position shown in the drawing or in any of the other three positions spaced from each other by 90° so that the axis 3 is arranged to the south, to the north, to the east, or to the west of the axis 12 respectively. Several models of the timepiece with different appearances can thus easily be produced. At the same time the adjustment member 6 remains on the central axis 12 of the case, so that the shape of the case is not limited.

Naturally, the principle of the invention remaining the same, the forms of embodiment and details of construction may be varied widely with respect to those described and illustrated purely by way of example.

Thus the number of coupling elements 20 may be different from that illustrated in order to allow the display module to be mounted in any number of different positions. Moreover, the structure of the coupling elements 20 is not shown in detail since it may be of any type and, at the same time, it is clear that, for the purposes of the present invention, it is not the structure of the individual coupling elements that is important but the symmetrical arrangement of the various coupling elements about the central axis of the case.

What is claimed is:

1. A timepiece comprising a case having a central axis, a clock movement mounted in said case and having an output shaft defining a clock movement axis with said clock movement axis coinciding with said central axis of the case, a display module independent of said case and said clock movement for displaying time, said display module including at least one rotary member rotatable about an axis of said display module, coupling means symmetrically disposed about said central axis of said case for connecting said display module to said case in a selected one of a plurality of eccentric positions with the axis of said display module offset from said clock movement axis, and drive means operatively connecting said output shaft to said rotary member of said display module.

* * * * *